US008286925B1

(12) United States Patent
White, Jr.

(10) Patent No.: US 8,286,925 B1
(45) Date of Patent: Oct. 16, 2012

(54) UNIVERSAL POST

(76) Inventor: William J. White, Jr., Lynnfield, MA (US)

( * ) Notice: Subject to any disclaimer, the term of this patent is extended or adjusted under 35 U.S.C. 154(b) by 184 days.

(21) Appl. No.: 12/221,212

(22) Filed: Jul. 31, 2008

(51) Int. Cl.
*A45F 3/44* (2006.01)

(52) U.S. Cl. ..... 248/156; 248/218.4; 248/219.2; 248/530; 248/534; 256/19; 256/24; 256/25; 52/155

(58) Field of Classification Search ..... 248/156, 248/545, 530, 532, 127, 176.1, 205.1, 218.4, 248/219.2, 511, 518, 519, 534; 52/155, 165, 52/297, 157; 256/19, 24, 25; 108/25
See application file for complete search history.

(56) References Cited

U.S. PATENT DOCUMENTS

| | | | | |
|---|---|---|---|---|
| 204,246 | A * | 5/1878 | Pierce | 52/157 |
| 994,742 | A * | 6/1911 | Gregory | 52/297 |
| 3,119,588 | A * | 1/1964 | Keats | 248/158 |
| 3,527,355 | A * | 9/1970 | Boyer | 211/85.19 |
| 3,638,802 | A | 2/1972 | Westerfield | |
| 3,865,309 | A * | 2/1975 | Greenhalgh | 239/268 |
| 3,972,307 | A | 8/1976 | Marseillan | |
| 4,201,975 | A * | 5/1980 | Marcus | 340/908 |
| 4,940,201 | A * | 7/1990 | Kurth | 248/101 |
| 4,951,904 | A * | 8/1990 | Obenshain | 248/156 |
| 5,033,703 | A * | 7/1991 | Allen, Sr. | 248/97 |
| 5,139,219 | A * | 8/1992 | Navarro | 248/97 |
| 5,279,073 | A * | 1/1994 | Czebieniak | 47/48.5 |
| 5,666,940 | A * | 9/1997 | Kreiter | 126/30 |
| 5,857,664 | A * | 1/1999 | Schauman | 256/19 |
| 5,887,834 | A * | 3/1999 | Gellos et al. | 248/156 |
| 6,202,368 | B1 * | 3/2001 | Wallace, III | 52/157 |
| D448,911 | S | 10/2001 | Gaines et al. | |
| 6,299,125 | B1 * | 10/2001 | Zayeratabat | 248/530 |
| 6,439,517 | B1 | 8/2002 | Applegate | |
| 6,866,251 | B2 * | 3/2005 | Rosaen | 256/25 |
| 6,986,496 | B2 * | 1/2006 | Roberts et al. | 248/519 |
| 7,500,654 | B2 * | 3/2009 | Rosaen | 256/65.14 |
| 7,503,550 | B2 * | 3/2009 | Liefke | 256/24 |

FOREIGN PATENT DOCUMENTS

GB 002174131 A * 10/1986

* cited by examiner

*Primary Examiner* — Terrell McKinnon
*Assistant Examiner* — Todd M Epps
(74) *Attorney, Agent, or Firm* — Joseph R. Birkner

(57) ABSTRACT

A universal post having a tapered elongated member with a proximal end and a distal end such that the proximal end is larger in size than the distal end of the elongated member for receiving one of a trash receptacle and a mail box thereon. A stabilizer is disposed orthogonal to and radially extending from the distal end of the elongated member. The stabilizer being substantially greater in length than width for placement on a ground surface so that a weighted member, received thereupon the stabilizer together with the stabilizer, supports the elongated member in a substantially vertical, stationary position with respect to the ground surface. The universal post capable of use on a flat paved surface and on a flat unpaved surface with the addition of a spike. The universal post further usable as a movable fence.

8 Claims, 4 Drawing Sheets

UNIVERSAL POST

FIELD OF THE INVENTION

This invention relates generally to posts. More particularly, the present invention relates to a universal post for holding an empty trash receptacle; for supporting a mail box and for use with a rope as a movable portable fence.

BACKGROUND OF THE INVENTION

There are numerous prior art devices and methods for supporting objects, including signs, mail boxes and fence posts most of which involve a great deal of time and manual labor to implement or employ dedicated posts usable only for a specific application. None of them are designed to be universally adaptable to various applications other than a single purpose; therefore separate posts and fences are necessary for each task thereby adding to material and labor costs. Further, none of the known prior art devices eliminate the dedicated intended usage, for the particular post; therefore such posts are not universal.

The inventor recognized a never before addressed problem and fulfilled a need which overcomes the limitations and issues associated with posts for supporting and for restraining various objects, with, for example, a fence.

In view of the above mentioned problems and limitations associated with conventional posts and fences, it was recognized by the present inventor that there is an unfulfilled need for a universal post that is readily adaptable for use as a trash receptacle holder, a mail box support and a movable fence in lieu of separate posts.

Accordingly, it becomes clear that there is a great need for a universal post which overcomes the disadvantages associated with present posts. Such a universal post should be one that works as desired, is safe and easy to use and is economically manufactured.

SUMMARY OF THE INVENTION

It is therefore an object of this invention to provide a universal post which avoids the aforementioned problems of prior art posts.

It is another object of this invention to provide a universal post that can be readily adaptable for use as a trash receptacle holder, a mail box support and a movable fence, one which is portable, in lieu of separate posts.

It is another object of this invention to provide a universal post with a stabilizer for placement on a ground surface so that a weighted member, received thereupon the stabilizer, together with the stabilizer, supports an elongated member in a substantially vertical, stationary position with respect to the ground surface.

It is another object of this invention to provide a universal post that has a spike disposed on a distal end of an elongated member for engaging the earth and for supporting the elongated member in a substantially vertical, stationary position.

It is another object of this invention to provide a universal post that can be used on a flat paved surface such as a street, a walk, a driveway and a patio.

It is another object of this invention to provide a universal post that can be used on a ground earth surface such as a lawn.

It is a further object of this invention to provide a universal post which may be manufactured from readily available materials by conventional manufacturing processes.

It is still a further object of this invention to provide a universal post that is simple in design, simple to manufacture, low in cost, safe and is easy and fun to use.

This invention results from the realization that there is a great need for a highly functional universal post suitable for multiple applications; the resulting invention provides such benefits.

According to a first aspect of the present invention, disclosed is a universal post comprising an elongated member having a proximal end and a distal end. The elongated member is tapered such that the proximal end is larger in size than the distal end of the elongated member for receiving a trash receptacle thereon the proximal end of the elongated member. A stabilizer is disposed orthogonal to and radially extending from the distal end of the elongated member. The stabilizer being substantially greater in length than width for placement on a ground surface so that a weighted member, received thereupon the stabilizer, together with the stabilizer, supports the elongated member in a substantially vertical, stationary position with respect to the ground surface. The elongated member having an aperture therein the proximal end for receiving a mail box and the elongated member having a bore, vertically disposed, therein for receiving a rope for use as a movable fence.

The second aspect, in accordance with the present invention, is a special case of the first aspect of this invention with additional features further comprising a spike disposed on the distal end of the elongated member for engaging the earth and for supporting the elongated member in a substantially vertical, stationary position.

DETAILED DESCRIPTION OF ILLUSTRATIVE EMBODIMENTS

Figure 1:
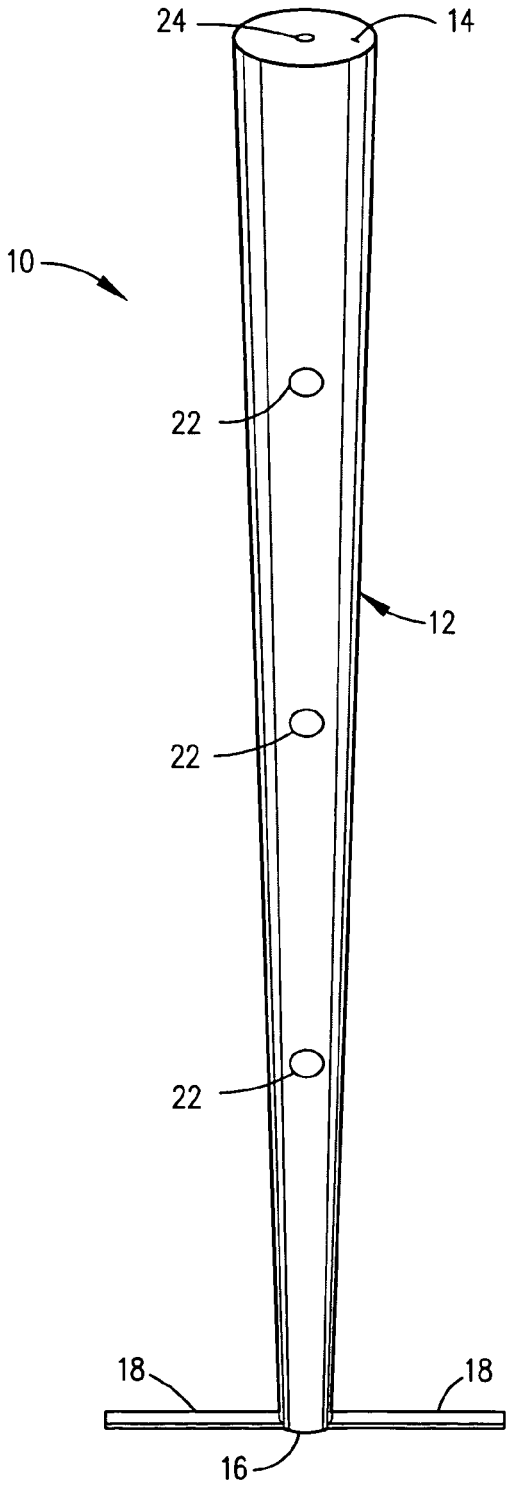
FIG. 1 is a perspective view of an illustrative embodiment of a universal post of the instant invention.

Looking more particularly to the drawings, there is shown in FIG. 1 an illustrative embodiment of a universal post, which is generally indicated at 10, according to an embodiment of the present invention.

FIG. 1 is a perspective view of an illustrative embodiment of a universal post of the instant invention.

Figure 6:
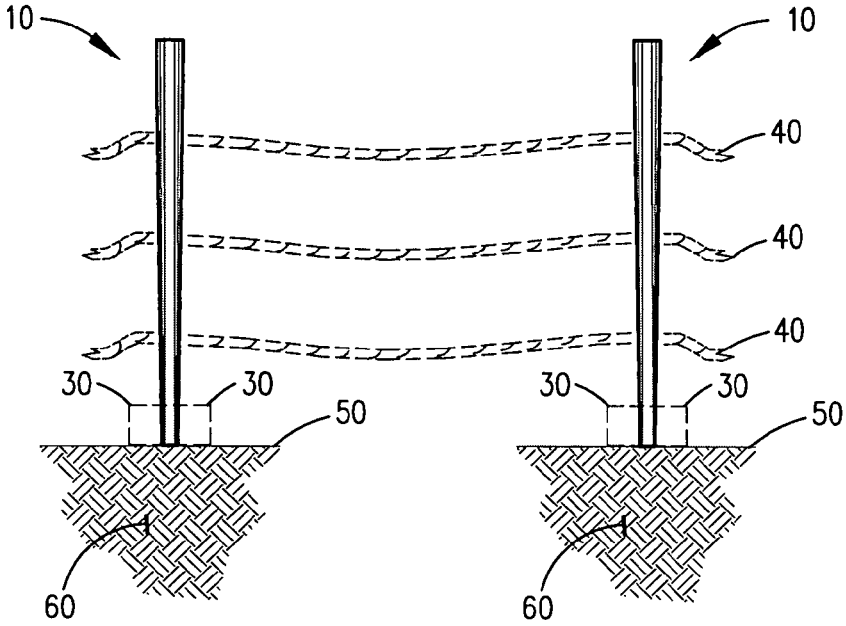
FIG. 6 is a side elevation view of the universal post of FIG. 1 in use on a ground surface for use as a movable fence with a rope and a weighted member both shown in phantom.
Figure 4:
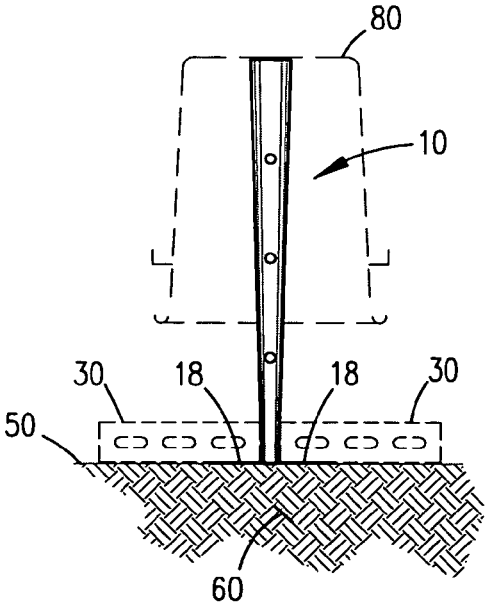
FIG. 4 is a front elevation view of the universal post of FIG. 1 in use on a ground surface with a trash receptacle and a weighted member both shown in phantom.
Figure 5:
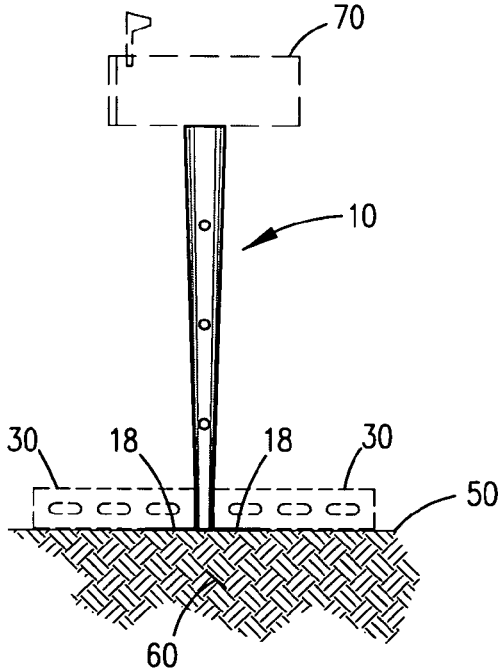
FIG. 5 is a front elevation view of the universal post of FIG. 1 in use on a ground surface with a mail box and a weighted member both shown in phantom.

FIG. 1 shows a universal post 10 comprising an elongated member 12 having a proximal end 14 and a distal end 16. The elongated member 12 is tapered such that the proximal end 14 is larger in size than the distal end 16 of the elongated member 12 for receiving a trash receptacle 80 (shown in phantom in FIG. 4) thereon the proximal end 14 of the elongated member 12. Taper is critical for providing a suitable receiving surface thereon for the trash receptacle 80 (and a mail box 70 shown in phantom in FIG. 5). A stabilizer 18 is disposed orthogonal to and radially extending from the distal end 16 of the elongated member 12. The stabilizer 18 being substantially greater in length than width for placement on a ground surface 50 so that a weighted member 30 (shown in phantom in FIGS. 4-6), received thereupon the stabilizer 18, together with the stabilizer 18, supports the elongated member 12 in a substantially vertical, stationary position with respect to the ground surface 50 as best seen in FIGS. 4-6.

As best seen in FIGS. 1-6, the universal post 10 has an aperture 24 therein the proximal end 14 of the elongated member 12 for receiving the mail box 70 (shown in phantom in FIG. 5) and the elongated member 12 has a bore 22, vertically disposed, therein for receiving a rope 40 (shown in phantom in FIG. 6) for use as a movable fence.

Figure 2:
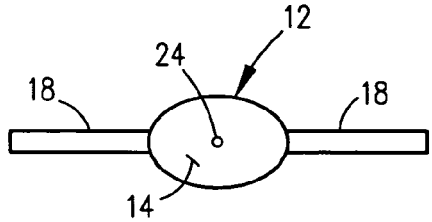
FIG. 2 is a top plan view of the universal post of FIG. 1.

FIG. 2 is a top plan view of the universal post 10, of FIG. 1 and shows the elongated member 12 with the aperture 24 on the proximal end 14. Also seen is the stabilizer 18.

Figure 3:
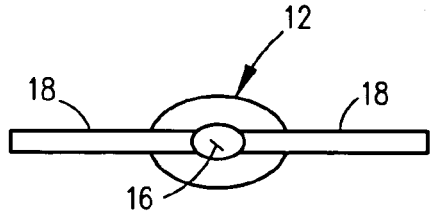
FIG. 3 is a bottom plan view of the universal post of FIG. 1.

FIG. 3 is a bottom plan view of the universal post 10, of FIG. 1 and shows the elongated member 12 with the stabilizer 18 disposed orthogonal to and radially extending from the distal end 16 of the elongated member 12.

The universal post 10, as seen in use in FIGS. 4-6 is essentially free standing and rests on the ground surface 50 without penetrating the ground sub surface (earth) 60 and is supported by the received weighted member 30 shown in phantom which may be any suitable object having sufficient weight such as, preferably, a concrete block. This arrangement allows the universal post 10 to be used preferably on a flat, paved surface such as, for example, a street, a walk, a driveway and a patio where ground breaking is not practical. It is understood that an unpaved flat surface such as a lawn could also accommodate the universal post 10. Essentially, this embodiment is a "street version".

FIG. 4 is a front elevation view of the universal post 10, of FIG. 1, in use on a ground surface 50 with the trash receptacle 80 and the weighted member 30 both shown in phantom.

FIG. 5 is a front elevation view of the universal post 10, of FIG. 1, in use on a ground surface 50 with the mail box 70 and a weighted member 30 both shown in phantom.

FIG. 6 is a side elevation view of the universal post 10, of FIG. 1, in use on a ground surface 50 as a portable fence with a rope 40 and a weighted member 30 both shown in phantom.

To make the universal post 10 even more useful, a second illustrative embodiment, with the addition of a spike 20 as best seen in FIGS. 7-12, is provided. Essentially, this embodiment is a "yard version".

Figure 7:
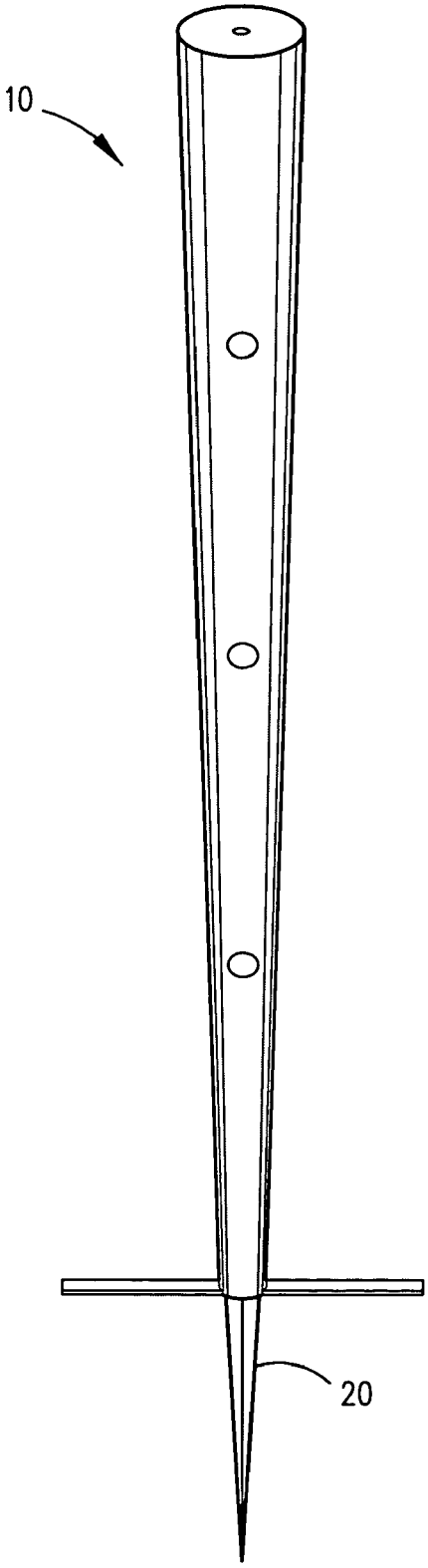
FIG. 7 is a perspective view of a second illustrative embodiment of a universal post of the instant invention with a spike.

Looking more particularly to the drawings, there is shown in FIG. 7 an illustrative embodiment of a universal post, which is generally indicated at 10, according to a second embodiment of the present invention.

FIG. 7 is a perspective view of a second illustrative embodiment of a universal post of the instant invention with a spike.

Figure 12:
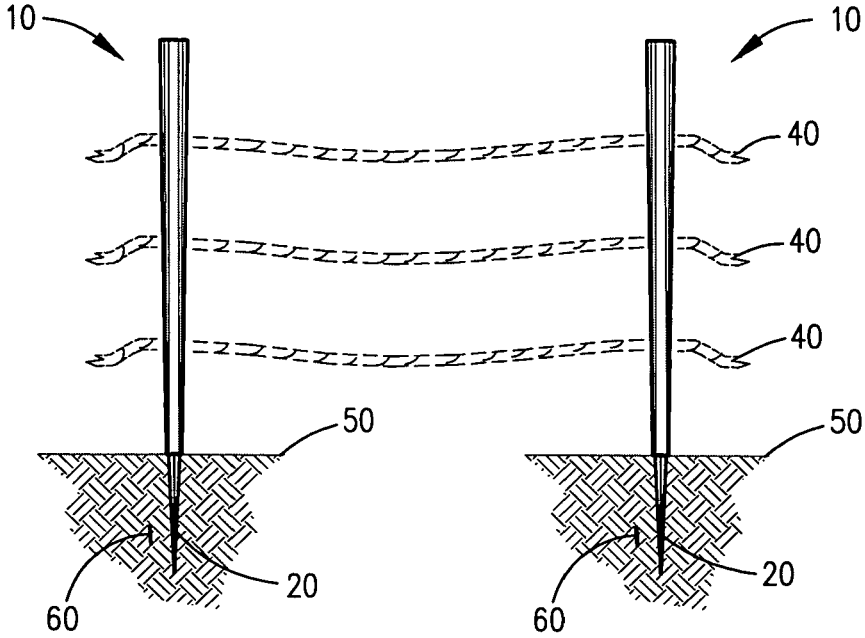
FIG. 12 is a side elevation view of the universal post of FIG. 7 in use on a ground surface and on a ground sub surface (earth) for use as a movable fence with a rope shown in phantom.
Figure 10:
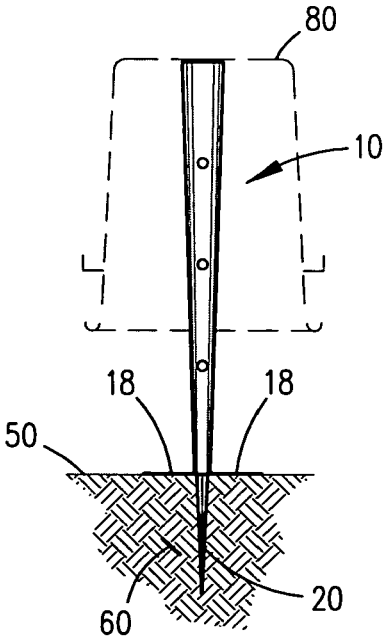
FIG. 10 is a front elevation view of the universal post of FIG. 7 in use on a ground surface and on a ground sub surface (earth) with a trash receptacle shown in phantom.
Figure 11:
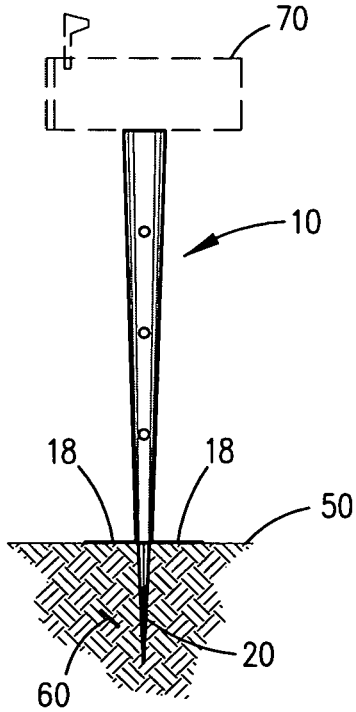
FIG. 11 is a front elevation view of the universal post of FIG. 7 in use on a ground surface and on a ground sub surface (earth) with a mail box shown in phantom.

FIG. 7 shows the universal post 10 as described above with the addition of the spike 20 disposed on the above described distal end 16 of the elongated member 12 for engaging the earth 60 and for supporting the elongated member 12 in a substantially vertical, stationary position as best seen in FIGS. 10-12. The spike 20 being critical for supporting the universal post 10 in a yard on a ground sub surface (earth) 60 such as a lawn when driven into the earth 60 with the stabilizer 18 providing additional support while laying on the ground surface 50. The elongated member 12, preferably being oval in shape and tapered, such that the proximal end 14 is larger in size than the distal end 16 of the elongated member 12 so that one of a trash receptacle 80 and a mail box 70 may be received thereon the proximal end 14 of the elongated member 12. The particular, preferred shape is also critical for providing a sufficient surface thereupon the proximal end 14 for hammering thereupon during installation. Other shapes may also be used as necessary. Although not necessary, it is understood that the weighted member 30 may optionally be used for added support, as needed, together with the spike 20 without departing from this disclosure.

Figure 8:
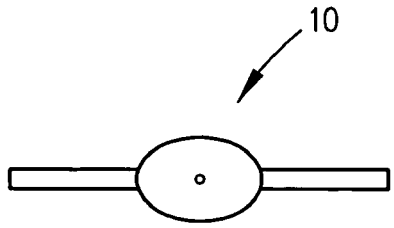
FIG. 8 is a top plan view of the universal post of FIG. 7.

FIG. 8 is a top plan view of the universal post 10, of FIG. 7.

Figure 9:
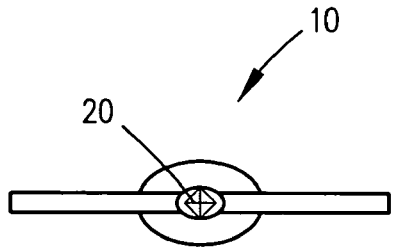
FIG. 9 is a bottom plan view of the universal post of FIG. 7.

FIG. 9 is a bottom plan view of the universal post 10, of FIG. 7 showing, in particular, the spike 20.

The spike 20 of the universal post 10, as seen in use in FIGS. 10-12, penetrates the ground sub surface (earth) 60 with the stabilizer 18 resting on the ground surface 50. This arrangement allows the universal post 10 to be used preferably on a flat, unpaved surface such as, for example, a lawn. Essentially, this embodiment is a "yard version".

FIG. 10 is a front elevation view of the universal post 10, of FIG. 7 in use on a ground surface 50 and on a ground sub surface (earth) 60 with a trash receptacle 80 shown in phantom.

FIG. 11 is a front elevation view of the universal post 10, of FIG. 7 in use on a ground surface 50 and on a ground sub surface (earth) 60 with a mail box 70 shown in phantom.

FIG. 12 is a side elevation view of the universal post 10, of FIG. 7 in use on a ground surface 50 and on a ground sub surface (earth) 60 as a movable fence with a rope 40 shown in phantom.

The universal post 10, in both illustrative embodiments, may be fabricated, preferably from plastic, by plastic molding. It is understood that other readily available materials, such as wood, metal and cement may be used for certain applications. Furthermore, when the universal post 10 is not unitarily molded or fabricated as a complete assembly, the stabilizer 18 and the spike 20, alternately, may be fabricated separately and attached to the elongated member 12 by conventional attachment means such as fasteners, friction fitting and adhesives.

The applicant has recognized a need and has solved a heretofore unknown problem in the prior art in creating a universal post 10 that is usable as a "street version" and as a "yard version". Surprisingly, the instant invention provides an added advantage and recognizes a problem and adequately and completely addresses an unfulfilled need, in that the universal post 10 in the manner disclosed, in effect, defines a highly functional and useful apparatus that is not presently available. This is due entirely to the particular way the applicant designed and fabricated the universal post 10 disclosed herein which are not found or taught in the prior art. By doing so, the applicant is able to use inexpensive materials in the fabrication without sacrificing performance, rather, achieving superior unexpected results, due to the particular construction which is cost effective.

One practical advantage of the invention is that it provides a convenient, practical, low cost, universal post 10 which allows a user to conveniently, and in an efficient manner, store a trash receptacle 80 after it is emptied thereby preventing it from rolling around in a street. Another advantage is the capability of holding a mail box 70 as well as for use with a rope 40, a wire, a tape or a bar or equivalent as a movable portable fence. Another advantage is that the universal post 10, unlike known posts, can be used on a flat paved surface and on a lawn depending upon a particular need. Still another advantage is that the universal post 10 is designed for ease of manufacture by standard methods such as by plastic molding and by using readily available materials particularly chosen for the problem solved.

Of course, a wide variety of further uses and advantages of the present invention will become apparent to one skilled in the art. As disclosed, it is apparent that one skilled in the art will realize that the foregoing discussion outlines the more important features of the invention to enable a better understanding of the instant invention and to instill a better appreciation of the inventors contribution to the art. It must be clear that the disclosed details of construction, descriptions of geometry and illustrations of inventive concepts are mere examples of possible manifestations of the invention.

Although the invention has been shown and described with reference to certain illustrative embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A universal post comprising: an elongated member having a proximal end for selectively receiving a trash receptacle thereon and a distal end having a stabilizer for vertically supporting said elongated member in an upright position when a weighted member is externally received and placed on said stabilizer completely covering said stabilizer thereby allowing the weighted member to be visible during use;

said elongated member having multiple uses instead of a single dedicated use and said elongated member mountable on a ground surface that is paved and unpaved, said elongated member is solid and tapered along its entire length, said proximal end is larger in size than said distal end of said elongated member; and said stabilizer is thin, flat and substantially rectangular in shape and integral with said distal end of said elongated member and oppositely disposed orthogonal to said distal end of said elongated member at a distance sufficient enough to allow the weighted member received externally thereon to completely cover said stabilizer while the weighted member remains flat and parallel with respect to the ground surface and to said stabilizer so that the weighted member, received externally thereupon said stabilizer, together with said stabilizer, being sandwiched and wedged between the weighted member and the ground surface, supports said elongated member in a substantially vertical, stationary position with respect to the ground surface.

2. The universal post of claim 1, wherein said elongated member having an aperture partially and centrally disposed therein said proximal end without extending through said distal end.

3. The universal post of claim 1, wherein said elongated member having a bore therein, vertically and centrally disposed, therethrough.

4. The universal post of claim 1, wherein said elongated member having an aperture partially and centrally disposed therein said proximal end without extending through said distal end and said elongated member having a bore therein, vertically and centrally disposed, therethrough.

5. The universal post of claim 1, further comprising a spike disposed on said distal end of said elongated member without said spike passing through said stabilizer.

6. The universal post of claim 5, wherein said elongated member having an aperture partially and centrally disposed therein said proximal end without extending through said distal end.

7. The universal post of claim 5, wherein said elongated member having a bore therein, vertically and centrally disposed, therethrough.

8. The universal post of claim 5, wherein said elongated member having an aperture partially and centrally disposed therein said proximal end without extending through said distal end and said elongated member having a bore therein, vertically and centrally disposed, therethrough.

* * * * *